US011367346B2

(12) United States Patent
Kadar et al.

(10) Patent No.: US 11,367,346 B2
(45) Date of Patent: Jun. 21, 2022

(54) DIGITIZING AND MAPPING THE PUBLIC SPACE USING COLLABORATIVE NETWORKS OF MOBILE AGENTS AND CLOUD NODES

(71) Applicant: Nexar Ltd., Tel Aviv (IL)

(72) Inventors: Ilan Kadar, Tel Aviv (IL); Shmuel Rippa, Ramat Gan (IL); Roi Adadi, Tel Aviv (IL); Oren Meiri, Rishon Lezion (IL); Eliahu Brosh, Ramat Hasharon (IL); Bruno Fernandez-Ruiz, Kent (GB); Eran Shir, Ramat Hasharon (IL)

(73) Assignee: Nexar, Ltd., Tel Aviv (IL)

( * ) Notice: Subject to any disclaimer, the term of this patent is extended or adjusted under 35 U.S.C. 154(b) by 209 days.

(21) Appl. No.: 16/614,379

(22) PCT Filed: Jun. 6, 2018

(86) PCT No.: PCT/IL2018/050618

§ 371 (c)(1),
(2) Date: Nov. 18, 2019

(87) PCT Pub. No.: WO2018/225069

PCT Pub. Date: Dec. 13, 2018

(65) Prior Publication Data

US 2020/0090504 A1 Mar. 19, 2020

Related U.S. Application Data

(60) Provisional application No. 62/516,472, filed on Jun. 7, 2017.

(51) Int. Cl.
*G08G 1/01* (2006.01)
*G08G 1/16* (2006.01)
(Continued)

(52) U.S. Cl.
CPC ..... *G08G 1/0133* (2013.01); *G08G 1/0112* (2013.01); *G08G 1/0129* (2013.01); *G08G 1/0141* (2013.01)

(58) Field of Classification Search
CPC .. G08G 1/0133; G08G 1/0112; G08G 1/0129; G08G 1/0141; G08G 1/16; G08G 1/00; G08G 1/14; G05D 1/00
See application file for complete search history.

(56) References Cited

U.S. PATENT DOCUMENTS 6,295,503 B1 * 9/2001 Inoue ..... G01C 21/3461 340/905
2013/0150117 A1 6/2013 Rodriguez et al.
(Continued)

OTHER PUBLICATIONS

PCT/IL2018/050618, International Search Report, dated Aug. 29, 2018, 10 pages.

(Continued)

*Primary Examiner* — Yonel Beaulieu
(74) *Attorney, Agent, or Firm* — Soquel Group I.P Ltd.

(57) ABSTRACT

A networked system for providing public space data on demand, including a plurality of vehicles driving on city and state roads, each vehicle including an edge device with processing capability that captures frames of its vicinity, a vehicle-to-vehicle network to which the plurality of vehicle are connected, receiving queries for specific types of frame data, propagating the queries to the plurality of vehicles, receiving replies to the queries from a portion of the plurality of vehicles, and delivering matched data by storing the matched data into a centralized storage server, and a learner digitizing the public space in accordance with the received replies to the queries.

8 Claims, 17 Drawing Sheets

(51) Int. Cl.
*G08G 1/00* (2006.01)
*G08G 1/14* (2006.01)

(56) References Cited

U.S. PATENT DOCUMENTS

| | | | | |
|---|---|---|---|---|
| 2016/0006922 | A1 | 1/2016 | Boudreau et al. | |
| 2016/0112461 | A1 | 4/2016 | Othmer | |
| 2020/0349666 | A1* | 11/2020 | Hodge | G06F 21/36 |
| 2021/0043087 | A1* | 2/2021 | Mezaael | B60N 2/0244 |
| 2021/0091956 | A1* | 3/2021 | Mullett | G06Q 20/065 |
| 2021/0091995 | A1* | 3/2021 | Trim | G06F 16/9035 |

OTHER PUBLICATIONS

PCT/IL2018/050618, Written Opinion, dated Aug. 29, 2018, 4 pages.

* cited by examiner

DIGITIZING AND MAPPING THE PUBLIC SPACE USING COLLABORATIVE NETWORKS OF MOBILE AGENTS AND CLOUD NODES

FIELD OF THE INVENTION

The present invention relates to a vehicle data on demand platform.

BACKGROUND OF THE INVENTION

Visibility as to what is happening on the road and its environmental surrounding helps improve the safety and efficiency of transportation infrastructures and systems. Conventional systems to gain visibility of city or state roads require expensive stationary hardware with limited reach, that collect visual and sensor-based road data. Conventional systems are expensive, and are limited in geographical coverage and data update frequency. At the same time, systems with mobile hardware have more extensive research, but are limited in their ability to capture large amounts of data and data update frequency. As such, they are unable to provide real-time insights.

It would thus be of advantage to have improved systems that are inexpensive, and that provide high quality road insight and mapping in real time.

SUMMARY

Embodiments of the present invention provide a collaborative network system, based on edge devices, such as smartphones, and cloud nodes, for digitizing and mapping the public space. Systems of the present invention leverage collaborative networks to make intelligent tradeoffs between computation and communication for high quality road insights and mapping. Systems of the present invention generate road maps and capture high-frequency localized road data in real time, by using mobile agents that capture the public space on-demand, visually and via sensors, and by using cloud-based machine learning for a thorough scene understanding. Systems of the present invention provides cities, transportation planners, third parties, drivers and other users, with insights including inter alia traffic patterns, real time vehicle routing, city dynamics and infrastructure management.

There is thus provided in accordance with an embodiment of the present invention a networked system for providing public space data on demand, including a plurality of vehicles driving on city and state roads, each vehicle including an edge device with processing capability that captures frames of its vicinity, a vehicle-to-vehicle network to which the plurality of vehicle are connected, receiving queries for specific types of frame data, propagating the queries to the plurality of vehicles, receiving replies to the queries from a portion of the plurality of vehicles, and delivering matched data by storing the matched data into a centralized storage server, and a learner digitizing the public space in accordance with the received replies to the queries.

There is additionally provided in accordance with an embodiment of the present invention a networked system for digitizing public space, including a plurality of mobile agents within vehicles, the mobile agents equipped with cameras and sensors and communicatively coupled via a vehicle network, the mobile agents continuously recording video, sensor data and metadata, and sending a portion of the recorded video, sensor data and metadata to a centralized cloud storage server, in response to receiving a query from a vehicle network server, the mobile agents including a learning machine (i) analyzing the video, sensor data and metadata to recognize objects in the video, sensor data and metadata, and (ii) determining which video, sensor data and metadata to send to the cloud, based on the received query, so as to maximize overall mutual information, and a centralized cloud storage server that receives the video, sensor data and metadata transmitted by the mobile agents, including an event classifier for analyzing event candidates and classifying events, and a query generator for directing the mobile agents to gather more information on a suspected event, via the vehicle network, and a map generator generating a dynamic city heatmap, and updating the heatmap based on subsequent videos, sensor data and metadata received by the mobile agent.

There is further provided in accordance with an embodiment of the present invention a computer-based method for providing public space data on demand, including propagating, by a vehicle network server, queries to a plurality of vehicles in communication with one another via a vehicle network, each vehicle including one or more edge devices that include cameras and other sensors, and that continuously generate videos, sensory data and metadata, transmitting a portion of the videos, sensory data and metadata to a centralized storage server, the portion being appropriate to one or more of the propagated queries, indexing and annotating the received videos, sensory data and metadata, by the centralized storage server, sensory data and metadata, and digitizing and mapping the public space, based on the indexed and annotated videos, sensory data and metadata.

BRIEF DESCRIPTION OF THE DRAWINGS

The present invention will be more fully understood and appreciated from the following detailed description, taken in conjunction with the drawings in which.

For reference to the figures, TABLE I provides an index of elements and their numerals. Similarly numbered elements represent elements of the same type, but they need not be identical elements.

TABLE I

Table of elements in the figures

Figure 1:
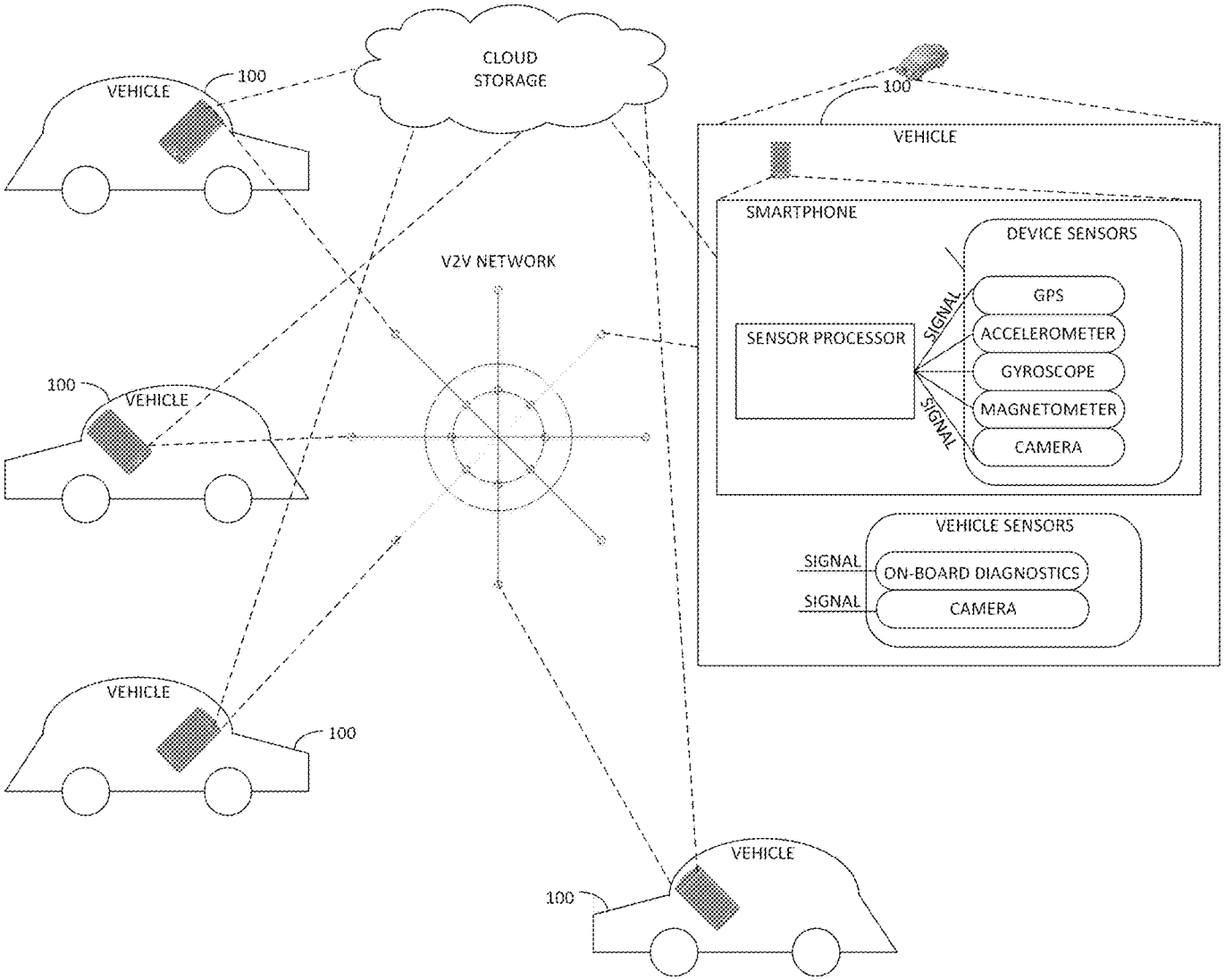
FIG. 1 is a simplified diagram of a data-on-demand (DoD) system, in accordance with an embodiment of the present invention.

| Element | Description |
|---|---|
| 100 | vehicles connected via a network |
| 105 | data-on-demand (DoD) client |
| 110 | query definition system |
| 115 | object store database |
| 120 | matched events system |
| 125 | annotation system |
| 130 | vehicle-to-vehicle (V2V) system |
| 131 | V2V queue |
| 135 | neural network |
| 140 | event stream |
| 145 | DoD query engine |
| 150 | matched event stream |
| 155 | query definitions web user interface (UI) |
| 160 | query definitions database |
| 165 | matched events web UI |
| 170 | matched events database |
| 175 | object insertion notification queue |
| 180 | annotation service |
| 185 | annotations database |
| 190 | annotations web UI |
| 195 | fetch commander |
| 200 | V2V queue |
| 205 | ride services |
| 210 | vehicle network |
| 211 | vehicle network manager |
| 212 | vehicle network message queue |
| 215 | centralized storage system |
| 220 | job executor |
| 225 | job scheduler |
| 230 | uniform resource names (URNs) |
| 240 | training and annotation module |
| 241 | mobile neural network |
| 242 | deep neural network |
| 243 | driver score |
| 244 | test model |
| 245 | review tool |
| 250 | analytics dashboard |
| 255 | data exploration dashboard |
| 310 | processing queue database |
| 320 | ride metadata database |
| 330 | data on-demand queries database |
| 340 | data warehouse database |
| 350 | analytics database |
| 360 | interactive database |
| 370 | inverted search index |
| 405 | inertial measurement unit (IMU) |
| 410 | geographic positioning system (GPS) |
| 415 | camera |

TABLE I-continued

Table of elements in the figures

| Element | Description |
|---|---|
| 420 | LiDAR |
| 425 | controller area network (CAN) |
| 430 | radar |
| 435 | ride manager |
| 440 | storage manager |
| 445 | connection manager |
| 450 | autonomous drive and advanced driver assistance system (AD/ADAS) |
| 455 | warning actuator |
| 460 | cloud |
| 470 | DoD controller |
| 480 | DoD processor |
| 490 | event detection database |
| 500 | HTTP server |
| 510 | in-memory stack system |
| 520 | data request message queue |
| 530 | data uploaded message queue |
| 540 | file server |
| 550 | HTTP proxy |

Elements numbered in the 1000's are operations of flow charts.

DETAILED DESCRIPTION

Proliferation of smartphones and Internet of Things (IoT) devices results in large volumes of data generated at edge devices. Access to actual field data to capture the variety and diversity of real-world situations, improves the software running on the edge devices. However, edge devices are limited in terms of their computational capabilities, to process all of their collected data in depth. In addition, edge device connectivity to the centralized servers with significantly larger computational resource availability is limited. These limitations are more acute when edge devices, such as LiDAR devices and cameras, rely on sensors that generate large volumes of data that communication networks are unable to transfer. Embodiments of the present invention implement a platform to select on-demand, the data to collect and transfer to the cloud.

Overview

Reference is made to FIG. 1, which is a simplified diagram of a data-on-demand (DoD) system, in accordance with an embodiment of the present invention. FIG. 1 shows a network of vehicles 100 that communicate with the cloud, each vehicle including an edge device such as a smartphone.

Figure 2:
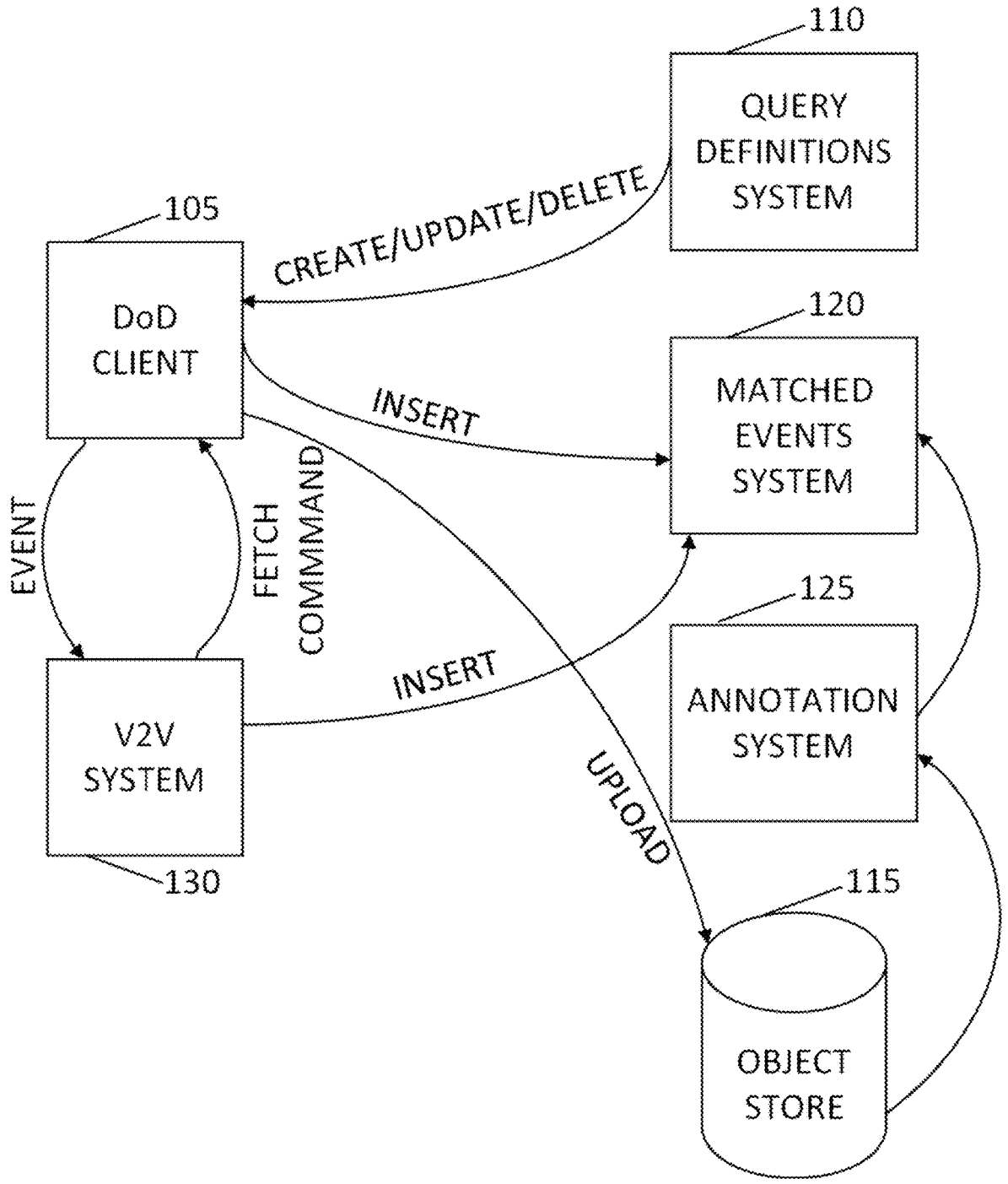
FIG. 2 is a simplified overview block diagram of a DoD system, in accordance with an embodiment of the present invention.

Reference is made to FIG. 2, which is a simplified overview block diagram of a DoD system, in accordance with an embodiment of the present invention. FIG. 2 shows a DoD client 105, which generates a continuous stream of data such as video and sensor data. DoD client 105 may reside in an edge device that is located in a moving vehicle. DoD client 105 receives create, update and delete instructions from a query definition system 110. DoD client 105 uploads object data into an object store 115, and inserts data that matches the query instructions into a matched events system 120. Object store 115 notifies an annotation system of objects that it stores, and annotation system 125 analyzes and tags the objects. A vehicle-to-vehicle (V2V) system 130 which communicates with DoD client 105, sends fetch commands to DoD client 105, and receives events from DoD client 105. V2V system 130 inserts events that match queries into matched events system 120.

Figure 3:
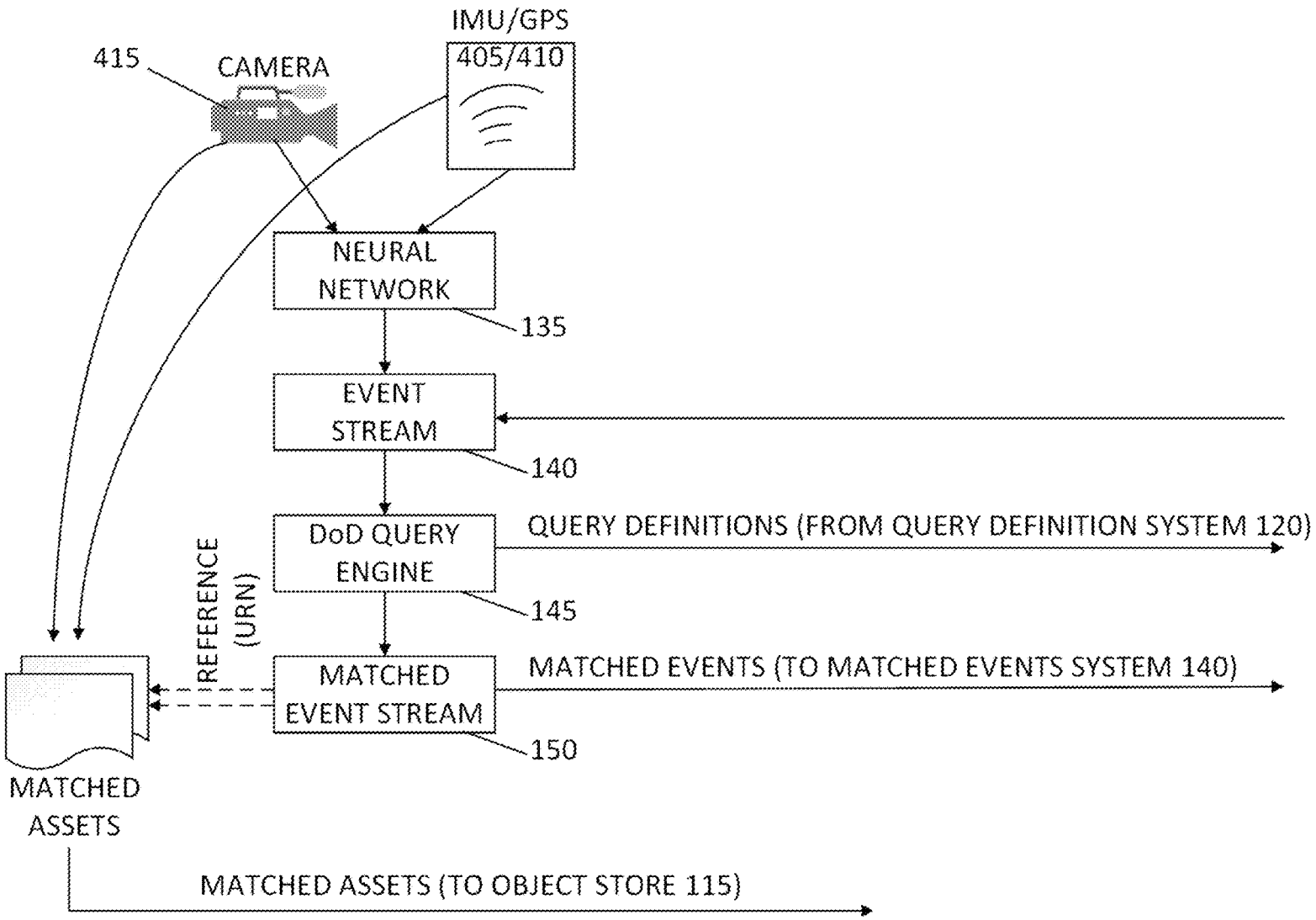
FIG. 3 is a simplified block diagram of the client in FIG. 2, in accordance with an embodiment of the present invention.

Reference is made to FIG. 3, which is a simplified block diagram of client 110, in accordance with an embodiment of the present invention. FIG. 3 shows edge devices; namely, an inertial measurement unit (IMU) 405/geographic positioning system (GPS) 410, and a camera 415. IMU 405/GPS 410 and camera 415 feed into a neural network 135. Neural network 135 generates data for event stream 140. Event stream 140 passes events to DoD query engine 145. DoD query engine receives queries from query definition system 110, matches queries with events, and passes matched events to matched event stream 150. Matched event stream 150 passes the matched events to matched events system 120. Matched event stream 150 also generates references, in the form of uniform resource names (URNs), to matched assets generated by IMU 405/GPS 410 and camera 415. The matched assets are then stored in object store 115.

Figure 4:
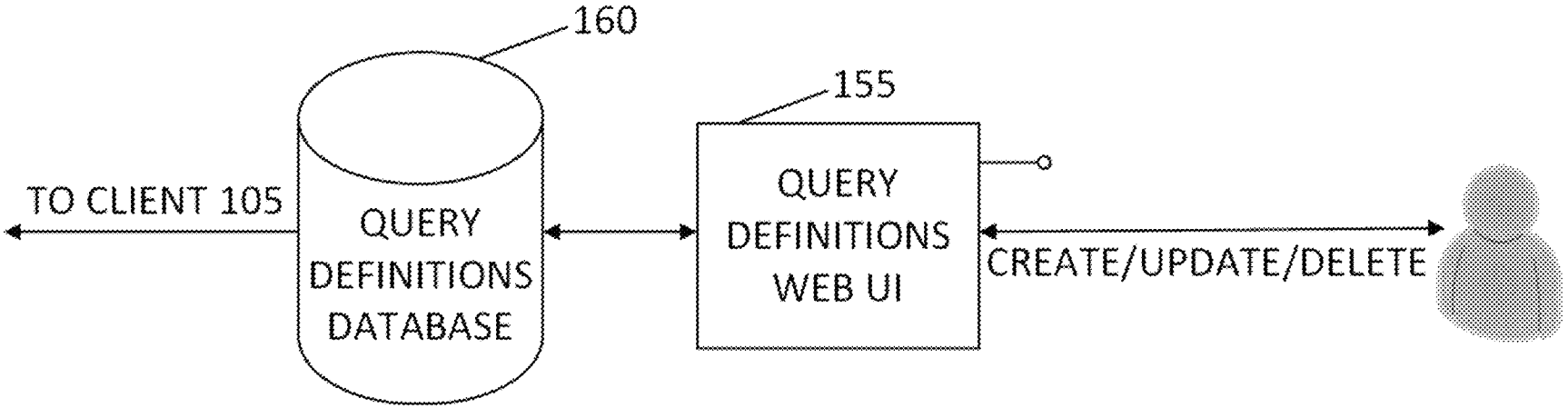
FIG. 4 is a simplified block diagram of the queries definitions system in FIG. 2, in accordance with an embodiment of the present invention.

Reference is made to FIG. 4, which is a simplified block diagram of queries definitions system 110, in accordance with an embodiment of the present invention. FIG. 4 shows a query definitions web user interface (UI) 155, for use by a human in creating, updating and deleting queries. Query definitions are stored in a query definitions database 160, which transmits the queries to client 105.

Figure 5:
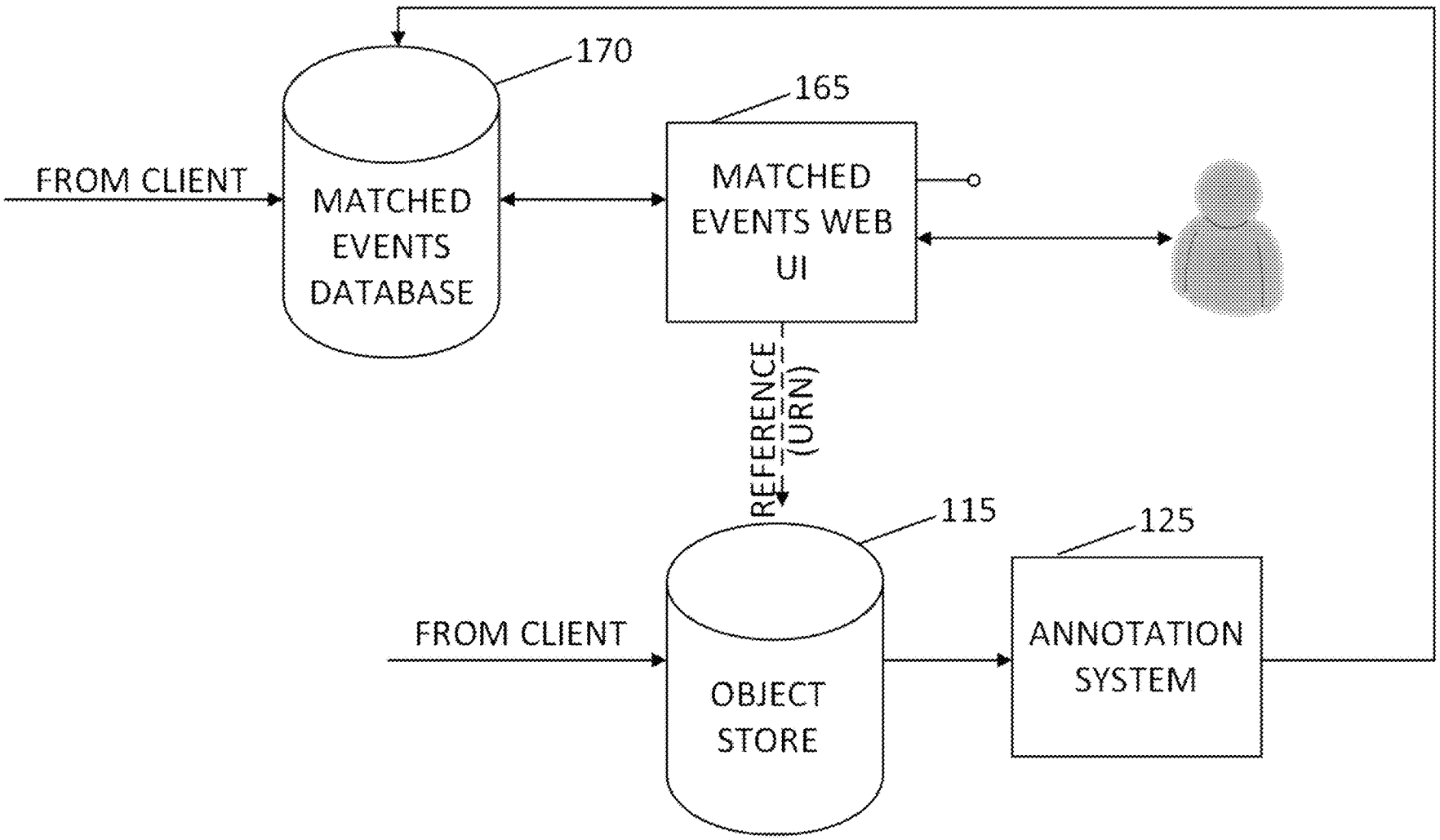
FIG. 5 is a simplified block diagram of the matched events system in FIG. 2, in accordance with an embodiment of the present invention.

Reference is made to FIG. 5, which is a simplified block diagram of matched events system 120, in accordance with an embodiment of the present invention. FIG. 5 shows a matched events web UI 165, for enabling a human to identify matched events. The matched events are stored in a matched events database 170. Matched events are also obtained from client 105. Match events web UI 165 resolves references to the matched assets in the form of URNs for match events, and the matched assets are stored in object store 115. Object store 115 also obtains data from client 105. Annotation system 125 analyzes and tags the objects in object store 115, and transmits the annotated objects to matched events database 170.

Figure 6:
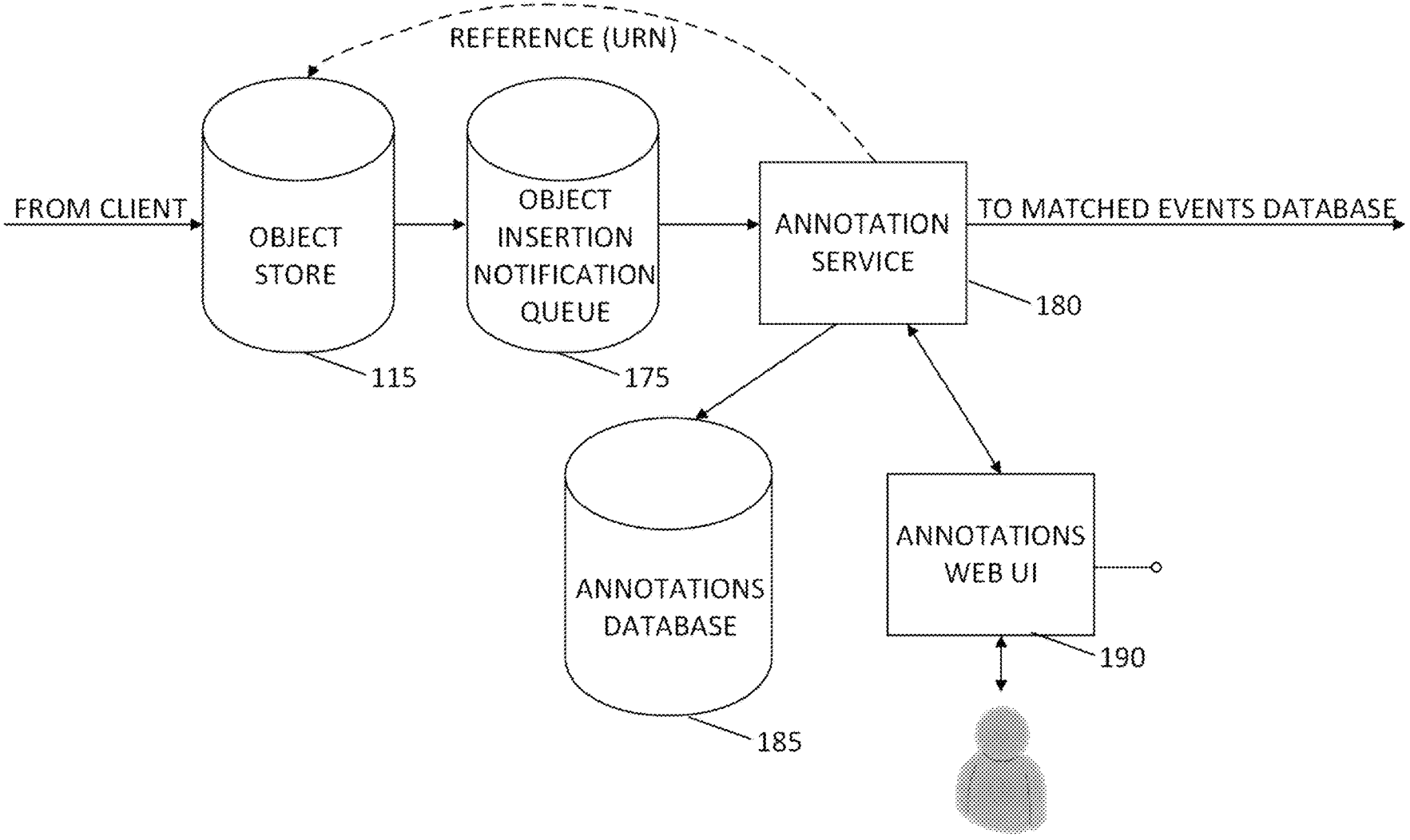
FIG. 6 is a simplified block diagram of the annotation system in FIG. 2, in accordance with an embodiment of the present invention.

Reference is made to FIG. 6, which is a simplified block diagram of annotation system 125, in accordance with an embodiment of the present invention. FIG. 6 shows objects from client 105 uploaded to object store 115. Uploads from client 105 occur when (i) client-side DoD query engine 145 matches, as shown in FIG. 3, (ii) a V2V query engine matches, or (iii) an end-ride/post-ride event occurs. The uploaded object is passed to an object insertion notification queue 175. Object insertion notification queue passes objects to annotation service 180. Annotation service 180 tags objects and inserts them into an annotations database 185. Annotation service 180 also provides an annotations web UI, to enable a human to provide annotations of objects. After the annotation is complete, annotation service 180 passes the annotated objects to matched events system 120.

Figure 7:
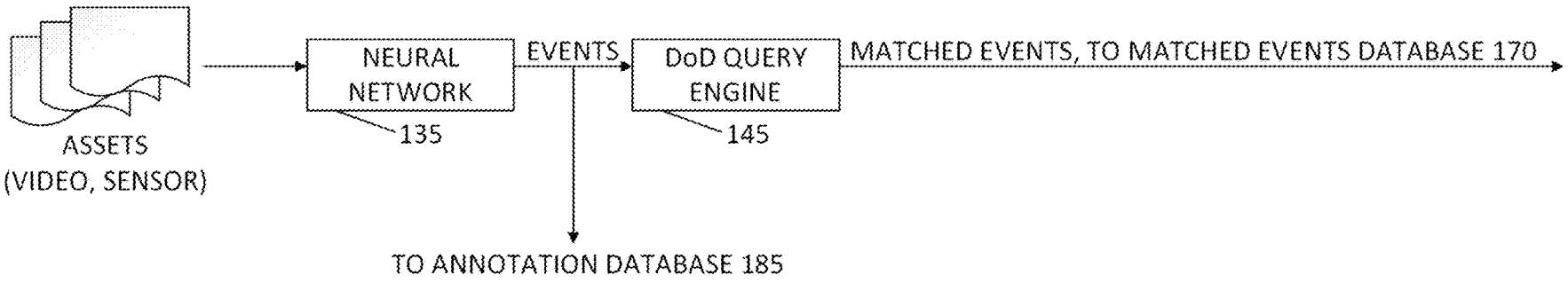
FIG. 7, which is a simplified block diagram of the annotation service of FIG. 6, in accordance with an embodiment of the present invention.

Reference is made to FIG. 7, which is a simplified block diagram of annotation service 180, in accordance with an embodiment of the present invention. FIG. 7 shows neural network 135 processing assets for tagging, including video and sensor data. Execution of neural network 135 is triggered by a message in object insertion notification queue 175. Neural network generates events for DoD query engine 145. The events are stored in annotations database 185. DoD query engine 145 passes matched events to matched events database 170.

Figure 8:
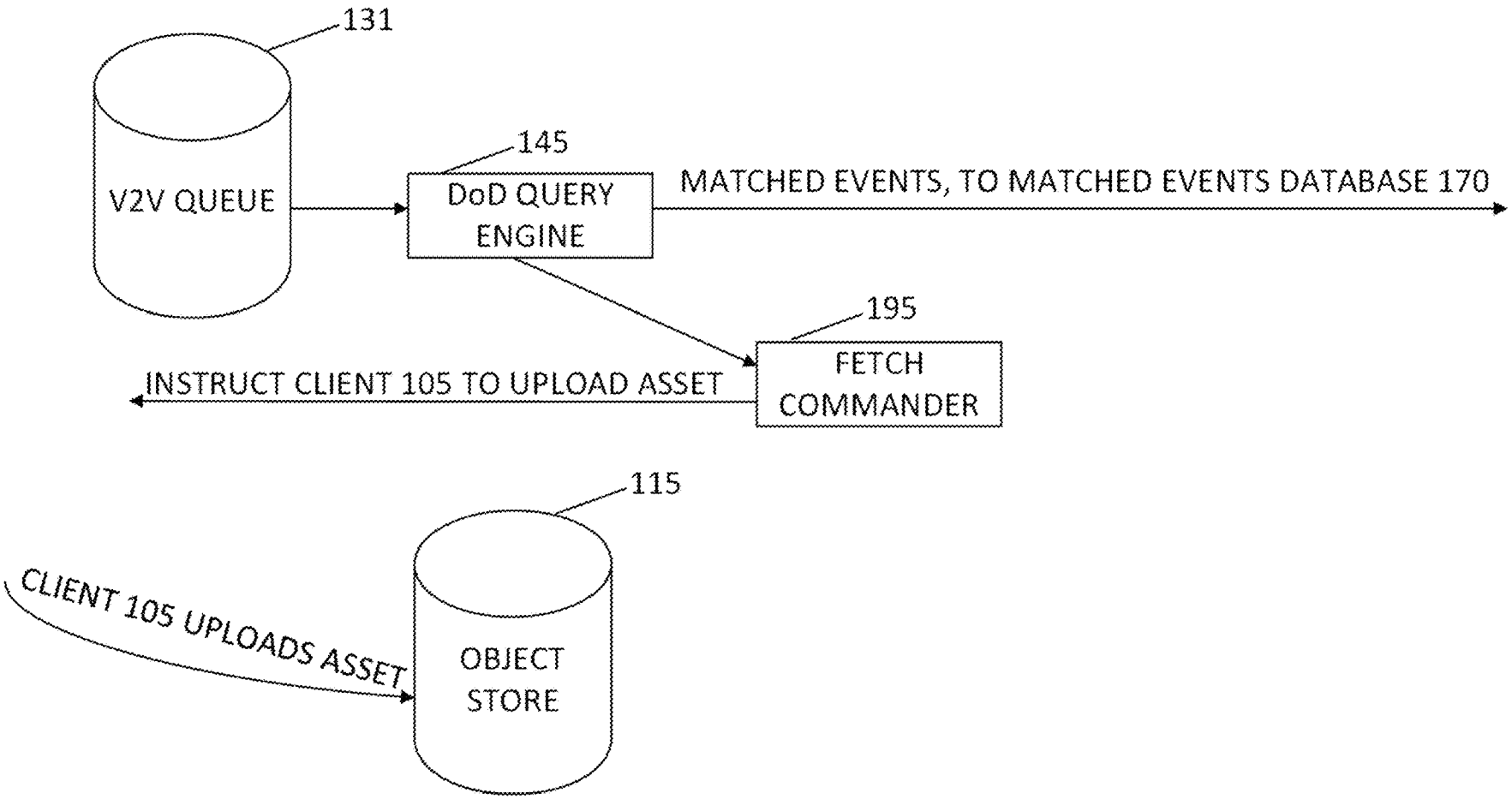
FIG. 8, which is a simplified block diagram of the V2V system in FIG. 2, in accordance with an embodiment of the present invention.

Reference is made to FIG. 8, which is a simplified block diagram of V2V system 130, in accordance with an embodiment of the present invention. FIG. 8 shows events from client 105 stored in a V2V queue 131. The events in V2V queue 131 are passed to DoD query engine 145. DoD query engine passes matched events to matched events database 170, and to a fetch commander 195, which instructs client 105 to upload assets. In response to the instruction from fetch commander 195, client 105 uploads assets to object store 115.

TABLE II below shows several components of a system according to an embodiment of the present invention. Features of the system support inter alia the following applications.

- traffic blockers, e.g., school buses, double parking, garbage trucks;
- traffic analytics, e.g., sidewalk pedestrian occupancy, car count and type statistics;
- infrastructure mapping, e.g., traffic sign detection, traffic light detection, traffic light phase and timing estimation, missing lane marking, speed sign recognition, guardrails, out of order traffic light;
- parking space detection;
- pedestrian counting and movement detection; and
- pattern detection across time and changes in the patterns, e.g., density of traffic divided by hours and seasons, and changes in density due to obstacles such as construction sites.

TABLE II

| System components | |
|---|---|
| Mobile agents | data collection of visual and sensory data with policies to maximize the overall collected mutual information<br>real-time road understanding of the collected data using efficient deep networks embedded in mobile agent<br>model adaptation to mobile agent environment, such as location and weather condition<br>data-on-demand policy: send to the cloud a compressed representation of the data, based on a policy defined by the network<br>optionally, crowdsourced deep network training is applied using a distributed back propagation algorithm that runs on mobile agents for fine-tuning and adapting the embedded models to new environments |
| Annotation service | online deep learning cloud-based with a human in the loop<br>active learner component to minimize the human effort<br>concept creation component for learning new concepts on-the-fly<br>vehicle-to-vehicle, and/or vehicle-to-infrastructure, and/vehicle-to-pedestrian network<br>dynamic city heatmaps for generation of city flow patterns, with the probability of existence of given objects in a specific geographical segment in a specific temporal range, e.g., Monday morning; the objects can be obstacles detected by the annotation service, e.g., a school bus, or assets, e.g., a stop sign |

Implementation Details

Rules for what data to gather from edge devices are defined as collection queries, which operate on streams of data sourced from the edge devices. Collection queries can refer to a single device, to multiple nearby devices, or to an entire network. Collection queries are written using a specific grammar, which runs on both clients and servers over streams of data events. TABLE III below provides exemplary attributes on which query predicates for collection criteria can relate to.

TABLE III

| Event attributes on which query predicates for collection criteria can relate to | |
|---|---|
| current environment | time<br>weather<br>lighting conditions |

TABLE III-continued

| Event attributes on which query predicates for collection criteria can relate to | |
|---|---|
| | road type |
| position and motion of vehicle | latitude/longitude |
| | altitude |
| | speed |
| | heading |
| | acceleration |
| position and motion of other observed vehicles | distance |
| | pose |
| | speed |
| | acceleration |
| actions and maneuvers a driver is performing | brake |
| | sharp turn |
| | hard acceleration |
| | tailgating |
| | traffic violation |
| | collision |
| | lane change |
| detections of camera | type |
| | distance |
| | pose |
| | confidence |

Embodiments of the present invention:

collect, annotate, analyze and sell driving data that is generated;

provide a server-side environment to allow automotive customers to semi-automatically annotate and analyze at large scale the data collected from fleets; and digitize the public space for mapping, and for smart cities.

Embodiments of the present invention offer data including inter alia frames, videos, radar, LiDAR, GPS and IMU, via an application programming interface (API). Users define characteristics of data they request using a query, and delivery of matched data to a user is performed by dropping the data into a centralized storage server that the user has access to. A data analytics tool is provided, which drills down into the data and examines aggregate statistics.

The API provides a simple query language to define the data to be collected. Queries are stored, and used to define what data is to be transferred from devices at the edge to the cloud. As shown in exemplary TABLE IV below, a query can SELECT fields. A query can include a WHERE predicate to specify criteria that the data must meet. A query can optionally specify clauses LIMIT, ORDER BY and GROUP BY, to refine what data is selected.

TABLE IV

| Query Language | | |
|---|---|---|
| SELECT | vehicle motion | position (latitude/longitude) |
| | | linear speed (m/s) |
| | | linear acceleration (m/s^2) |
| | | rotation (degrees) |
| | | angular acceleration (degrees/s^2) |
| | driver actions | acceleration (g) |
| | | braking (g) |
| | | steering (g) |
| | driver events | hard brake (confidence) |
| | | harsh acceleration (confidence) |
| | | sharp cornering (confidence) |
| | ADAS events | forward collision warning (FCW) (headway, confidence) |
| | | FCW (moving, confidence) |
| | | FCW (V2V, confidence) |
| | | lane departure warning (LDW) |
| | frame annotations (boolean, confidence) | vehicle classes |
| | | read signs |
| | | traffic lights |
| | | traffic light state |
| | | traffic light timing |
| | | pedestrians |
| | | pedestrian pose |
| | | parked vehicles |
| | | special vehicles |
| | | potholes |
| | | speed bumps |
| | object detections | bounding boxes (coordinates, confidence) |
| WHERE | geolocation | open street map (OSM) ID |
| | | geofencing |
| | date range | |
| | vehicle motion | speed, acceleration |
| | | rotation, angular acceleration |
| | driver actions | |
| | driver events | |
| | ADAS events | |
| | frame annotations | |
| | object detections | |
| | environment | light |
| | | weather |
| LIMIT | count | number of selected frames |
| | duration | equivalent cumulative driving time for the selected frames |
| ORDER BY | date | resolution of the matched results (day, week, month) |
| GROUP BY | geolocation | OSM ID |
| | | geofencing |

Exemplary queries are:

get 1,000 frames containing garbage trucks every week;

get 1,000 frames with bounding boxes for all vehicle types when the driver does a hard brake;

get 50 hours of driving from New York in the snow;

get 1,000 frames of police cars by night.

The platform components necessary to implement embodiments of the present invention are (i) a client-side platform-independent library (C++) with iOS and Android glue APIs, (ii) a server-side component responsible for managing the lifecycle for collection queries, (iii) a server-side component responsible for indexing and storing the client and server-side output streams, (iv) a server-side component annotation service responsible for indexing actual assets coming in, and (v) a server-side component responsible for indexing and resolving geo-spatial queries in a generic manner.

The client-side library (i) uses as much common code in the shared C++ library as possible, and minimizes the iOS and Android code to platform-specific operations. The client-side library is responsible for:

continuously keeping the active client-side collection queries in sync with the server;

executing the set of active queries, based on an input sensor stream of events (location, motion, detections), in order to match against the query, with an output stream of matching events;

consuming the matched event stream, generating the asset uniform resource name (URN) to be posted to the server, and feeding back the URN to the library;

syncing the output stream of matching events to the server.

The server-side component (ii) manages the lifecycle for collection queries, active and non-active, for all vehicles (single vehicle, group of vehicles, network level).

The server-side component (iii) provides a user interface (UI) to explore and query output streams, and resolves the matching assets, via the URN; i.e., to show it as a web UI.

The server-side component annotation service (iv) is responsible for:

feeding the stream of incoming assets; namely, the actual frames and videos, through a classification/detection pipeline, inter alia for vehicles, traffic lights, traffic signs and pedestrians;

indexing and storing the output stream, including the actual detections;

providing a UI to enable exploring the output stream on the actual assets;

providing a UI to enable humans for further annotate the assets manually; and storing the human annotations.

The server-side component (v) indexes and resolves geospatial queries in a generic manner, where the document being indexed contains a timestamp, a latitude/longitude, and an array of (document type, confidence) tuples.

Figure 9:
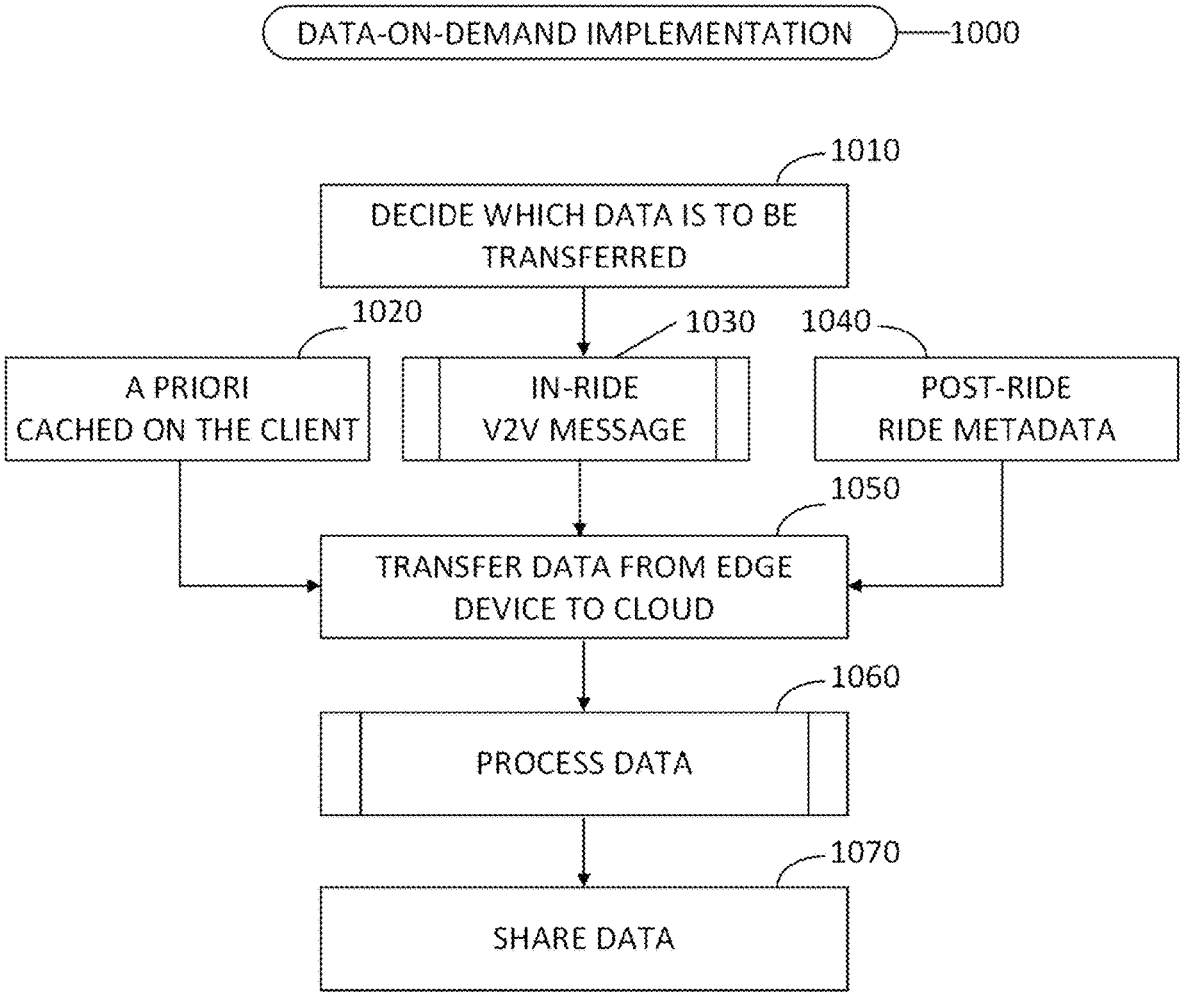
FIG. 9 is a simplified flowchart of an overall DoD method, in accordance with an embodiment of the present invention.

Reference is made to FIG. 9, which is a simplified flowchart of an overall DoD method 1000, in accordance with the present invention. At operation 1010, an edge device that takes a ride makes a decision as to which data is to be transferred. Some data is transferred a priori, from data matched based on collection strategies cached on the client, at operation 1020, before the ride begins. Some data is transferred in-ride, at operation 1030, during the ride, by sending messages over a vehicle network. Some data is transferred post-ride, at operation 1040, after the ride is finished.

The method of FIG. 9 is implemented by the API. The API decides which data to transfer from the edge device to the cloud, when to transfer the data, and how to transfer the data. Data may be transferred post-ride, in-ride and a priori. At operation 1020, for a priori transfer, data is cached on the client. Some simple selections are transformed onto DoD client collection strategies and pushed to the client device. Vision-based collection strategies, such as object classification and detection, are performed on the client side.

Figure 10:
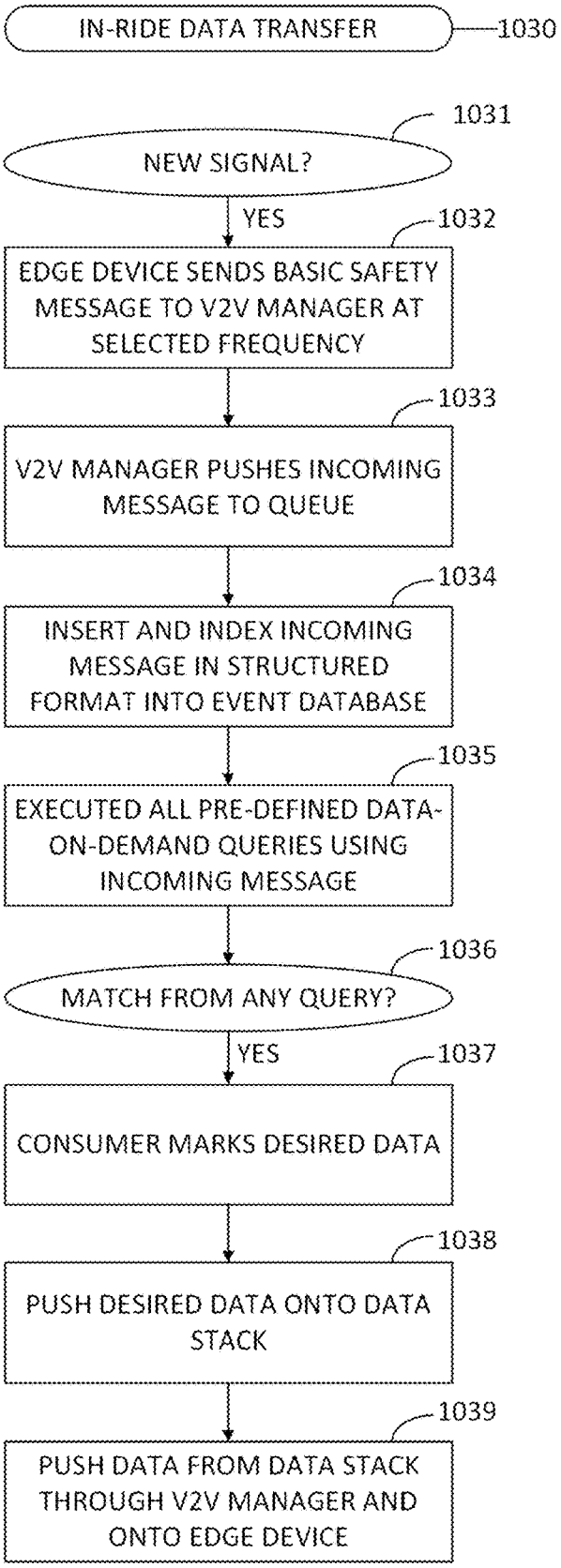
FIG. 10 is a simplified flowchart of in-ride data transfer, in accordance with an embodiment of the present invention.

Reference is made to FIG. 10, which is a simplified flowchart of operation 1030 for in-ride data transfer, in accordance with an embodiment of the present invention. At decision 1031 a determination is made whether there is a new signal, corresponding to a query SELECT field, from an edge device. If so, then at operation 1032 the edge device sends a basic safely message to the V2V manager. At operation 1033 the V2V manager, in addition to normal V2V responsibilities, pushes the incoming message to a queue. The queue allows multiple consumers for the same message, and relays already consumed messages, e.g., for a given ride ID.

Multiple consumers are subscribed to this queue. Upon consuming a message, at operation 1034 the queue inserts and indexes the incoming message in a structured format onto an event database. The event database is preferably a column database containing all world events ever encountered while driving with the application. At operation 1035 the queue executes all pre-defined data-on-demand queries, using the incoming message. At decision 1036 a determination is made whether there is a match from any query. If so, then at operation 1037 the edge device marks the desired data; e.g., for a pothole, one or two seconds before the pothole is detected. At operation 1038 the edge device pushes the requested data onto a requested data input in-memory stack system implementation, such as Redis, which stores the desired data by ride ID and timestamp. At operation 1039 another process consumes from the stack, and pushes through the vehicle network manager onto an edge device that desires that data.

At operation 1040, for post-ride transfer, when the ride metadata is updated, the full ride is observed, to determine if further specific data should be updated.

At operation 1050, the client transfers requested data to the cloud. There are two mechanisms for transfer. In the first mechanism, after a decision is made that data is required, either post-ride, V2V message or cached, the client pushes the requested data to a centralized object storage system acting as a message inbox. In the second mechanism, if the client fails to send the message after a V2V message request, when the client uploads the ride metadata at the end of the ride, a consumer checks what outstanding messages are left in the in-memory stack. The server consumer requests the client to upload the missing data.

A consumer of the centralized storage system acting as a message inbox, triggered, for example, by observing the storage file system and generating a notification when a file changes or is added or removed from such storage file system, processes the incoming data. If applicable, the consumer removes the corresponding DoD request from the requested data input message stack. The matching data is moved out of the inbox and stored in a DoD sub-folder in the centralized object storage system. The event in the database is updated with the URN for the data in the centralized object storage system.

Figure 11:
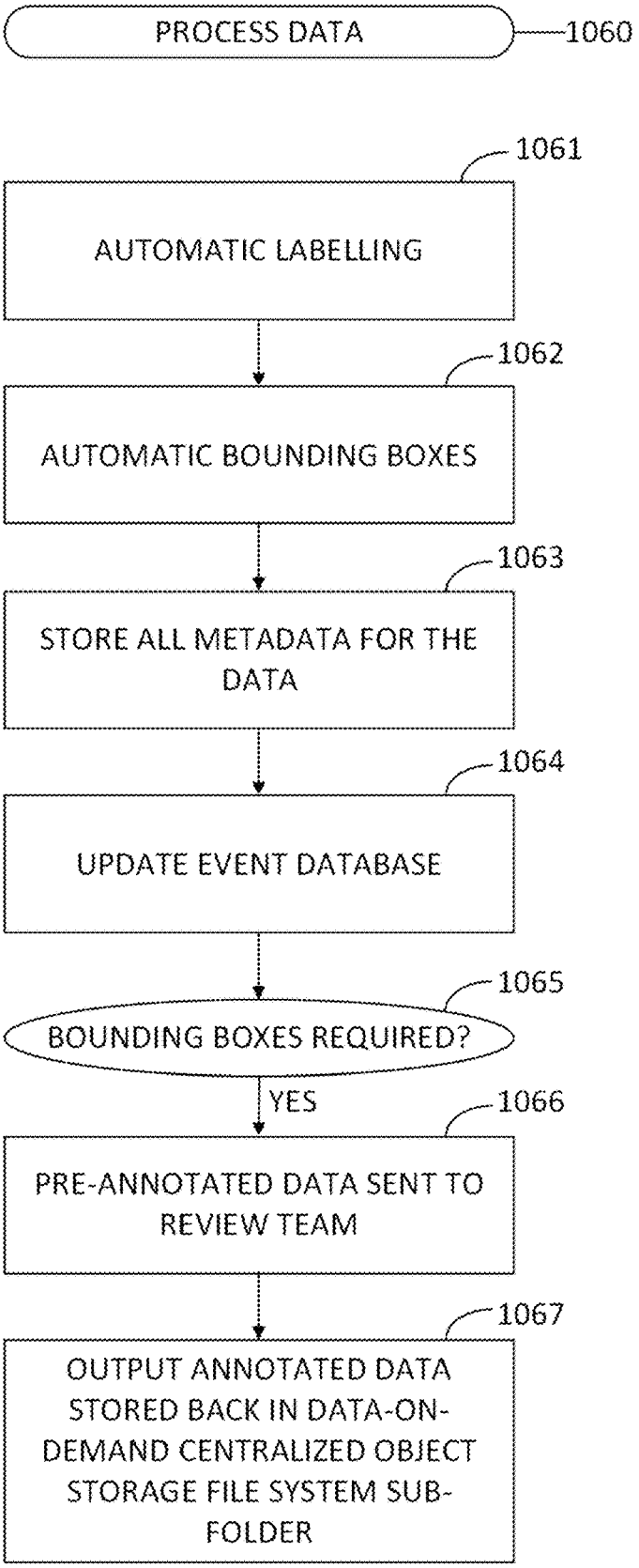
FIG. 11 is a simplified flowchart of processing data, in accordance with an embodiment of the present invention.

At operation 1060, as frames enter the DoD sub-folder in the centralized object storage system, a message notification based on observing changes to the object storage system triggers automatic data processing. Reference is made to FIG. 11, which is a simplified flowchart of operation 1060 processing data, in accordance with an embodiment of the present invention. At operation 1061, labelling is automatically performed; e.g., there is a police car in the picture. At operation 1062 bounding boxes are automatically generated; e.g., around pedestrians. At operation 1063 all metadata for the frame is stored; i.e., all dictionary fields in the query SELECT. At operation 1064 the event database is updated. At decision 1065 a determination is made whether the query requires bounding boxes. If so, then at operation 1066 the pre-annotated frame, by the automatic process, is sent to a review team. At operation 1067 the output annotated frame is also stored in the DoD centralized object storage file system sub-folder.

At operation 1070 the data is shared. The query statements are executed in the event database at the time units exposed in the ORDER BY clause, and the results are collated into an index file, such as JSON. The file is pushed to the customer, namely, to one or more pre-defined HTTP endpoints. The customer uses the JSON file to parse a record at a time, and extract the centralized object storage system's URN, exposed as an HTTP endpoint, which then queries the DoD HTTP server. In turn, the HTTP server retrieves the matched frame from the relevant centralized object storage file system folder.

Figure 12:
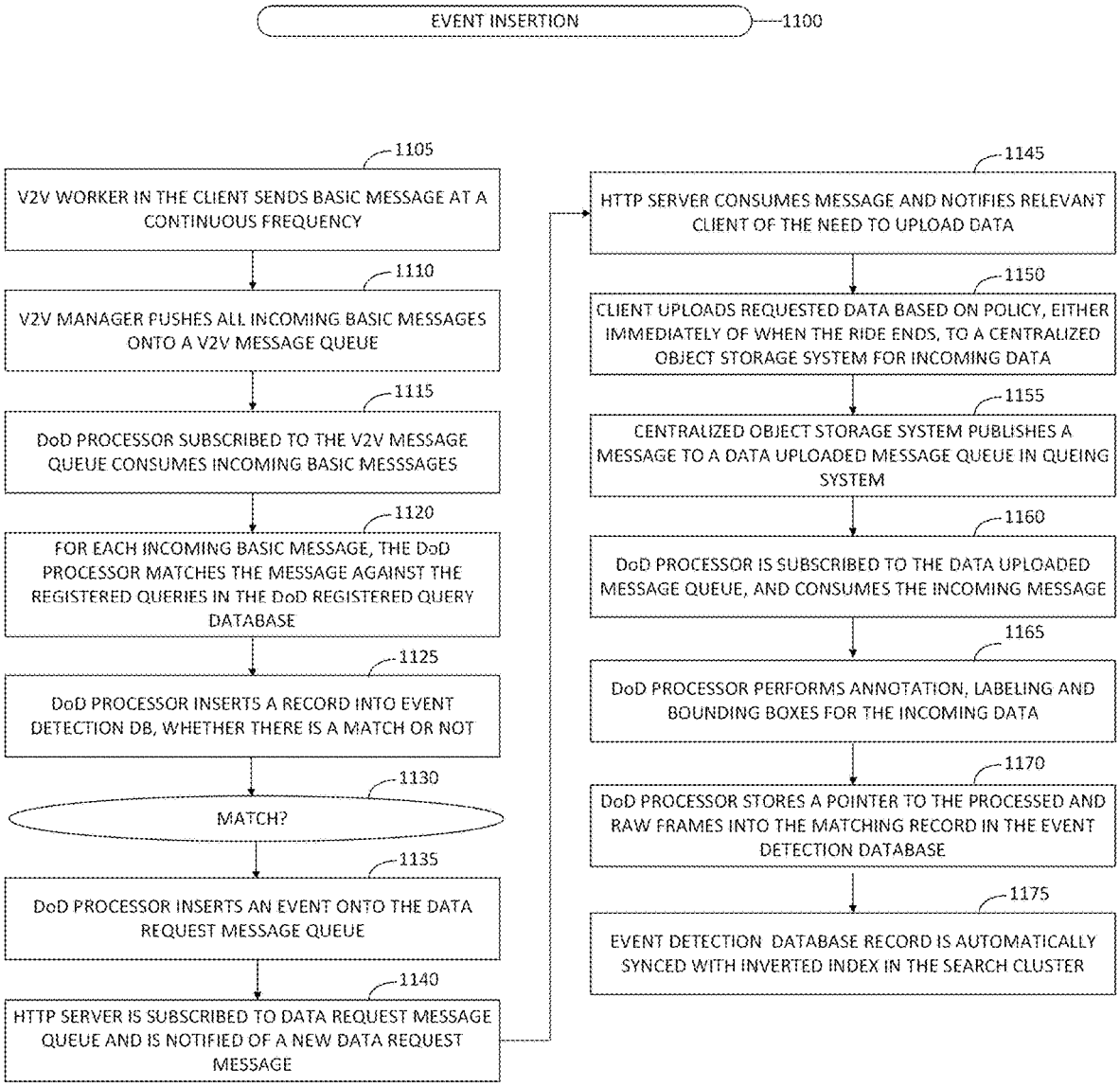
FIG. 12 is a simplified flowchart of a method for event insertion, in accordance with an embodiment of the present invention.

Reference is made to FIG. 12, which is a simplified flowchart of a method 1100 for event insertion, in accordance with an embodiment of the present invention. As clients drive around, the cloud continuously decides what to transfer. At operation 1105, a V2V worker in the client sends a basic message with position and motion data, at a continuous frequency. At operation 1110 the V2V manager publishes all incoming basic messages onto a V2V message queue. At operation 1115 a DoD processor is subscribed to the V2V message queue and consumes incoming basic messages. The DoD processor is non-interactive, and can share code with the DoD controller, but runs in its own memory and compute space.

At operation 1120, for each incoming basic message, the DoD processor matches the message against the registered queries in a DoD registered queries database. The operation is similar to how stream databases run, and opposite of a normal database paradigm. Specifically, in a normal paradigm queries are executed on a data corpus to select a number of matching data records. In a stream database, each new data record is matched against the query corpus to select a number of matching queries. In practice, in a stream database, it's not the queries that are executed for every new incoming data record, but rather a dual query in the data space is run matching against a database of queries. For the present embodiment, it is only necessary to determine whether the cloud should ask the client to send data matching the incoming basic message, and it is not necessary to determine which query triggered the collection request.

At operation 1125 the DoD processor inserts a record into an event detection database, regardless of whether there is a match. At decision 1130 a determination is made whether there is a match. At operation 1135, if there is a match, the DoD processor inserts an event into a frame request message queue. At operation 1140, the HTTP server is subscribed to the data request message queue, and is notified of a new data request message. At operation 1145, the HTTP server consumes the message and notifies the relevant client of the need to upload data. At operation 1150, the client uploads the requested data, based on the policy, either immediately or when the ride ends, to folder in the centralized object storage system for incoming data. At operation 1155, the centralized object storage system publishes a message notification to a data uploaded message queue in a queuing system. At operation 1160 the DoD processor is subscribed to the data uploaded message queue, and consumes the incoming message. At operation 1165, the DoD processor performs annotation, labeling and bounding boxes for the incoming frames. At operation 1170, the DoD processor stores a pointer to the processed and raw frames into the matching record in the event detection database. At operation 1175, the event detection database record is automatically synced with the inverted index in the search cluster.

Figure 13:
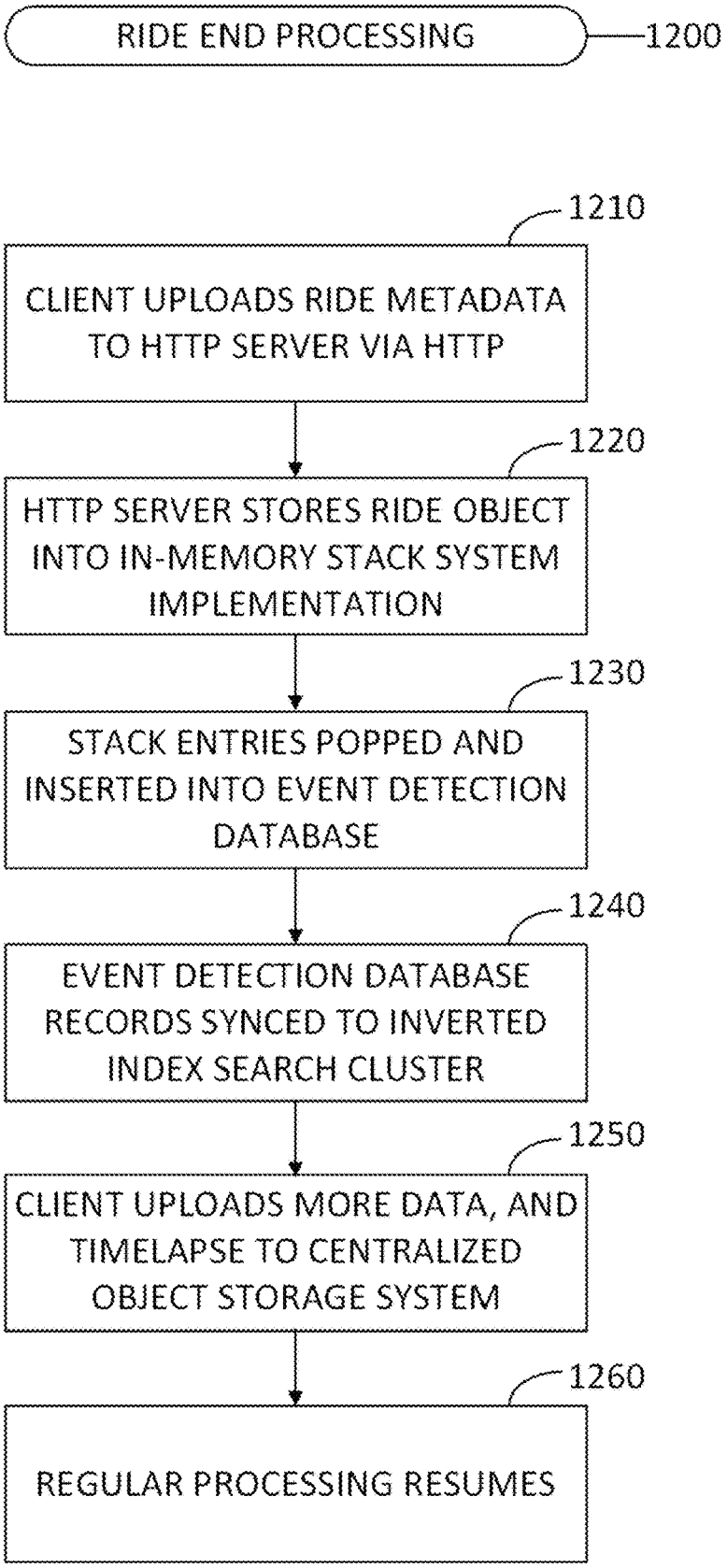
FIG. 13 is a simplified flowchart a method of ride-end processing, in accordance with an embodiment of the present invention.

Reference is made to FIG. 13, which is a simplified flowchart a method 1200 of ride-end processing, in accordance with an embodiment of the present invention. At ride-end, the client uploads all remaining data. At operation 1210 the client uploads the ride skeleton to the HTTP server via HTTP. At operation 1220 the HTTP server stores the ride object into the in-memory stack system implementation. At operation 1230 stack entries are popped and inserted into the event detection database. At operation 1240 the event detection database records are synced to the inverted index search cluster. At operation 1250 the client uploads more data and their time lapse to the centralized object storage system. At operation 1260 regular processing resumes.

Figure 14:
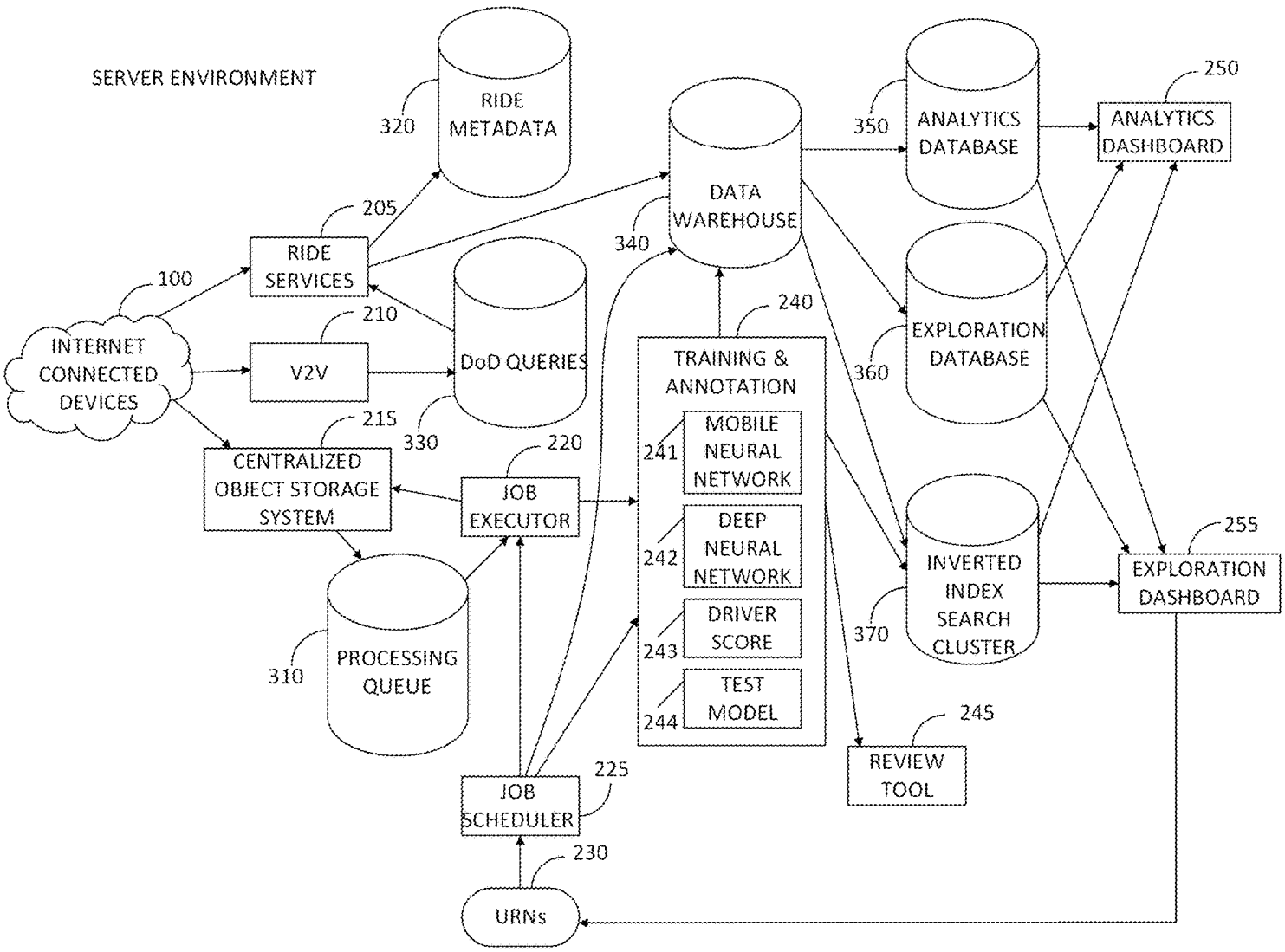
FIG. 14 is a high-level dataflow diagram for a server-side environment, in accordance with an embodiment of the present invention.

Reference is made to FIG. 14, which is a high-level dataflow diagram for a server-side environment, in accordance with an embodiment of the present invention. Shown in FIG. 14 are a plurality of Internet connected devices 100, a plurality of systems 205-255, and a plurality of databases 310-370. The systems include ride services 205, vehicle-to-vehicle (V2V) network 210, a centralized object storage system 215, job executor 220, job scheduler 225, uniform resource names (URNs) 230, training and annotation module 240, review tool 245, analytics dashboard 250 and exploration dashboard 255. Training and annotation module 240 includes mobile neural network 241, deep neural network 242, driver score 243 and test model 244. The databases include processing queue 310, ride metadata 320, data on-demand queries 330, data warehouse 340, analytics database 350, interactive database 360 and inverted index search cluster 370.

Job scheduler 225 receives, accepts and runs jobs. Jobs can be run once, at a scheduled time, at regular intervals, or continuously streamed. Each job belongs to a type, and each type defines inputs and output schema. Preferably, a manually curated dictionary captures all possible schema. Jobs determine their input dataset. Batch jobs either provide a URN to a centralized object storage file system folder containing all of the training samples, or provide the URN for a file containing URNs for all of the training samples, or directly provide a list of URNs.

Job scheduler 225 manages an inference environment. Job scheduler 225 is connected to a container management system, which are scripts monitoring and managing the lifecycle of virtual server instances, to manage environment scaling. Job scheduler 225 determines and deploys the appropriate inference engine; namely, container+framework+architecture+model, and triggers a data loader to start feeding. The data loader feeds samples for inference, waits for a response, and stores output into the data warehouse 340. The data in the warehouse is then further indexed and made available for human analysis in an in-memory analytics database optimized for interactive queries 360, in an inverted index search cluster 370, analytics database 350, and exposed through an analytics dashboard 250 and an exploration dashboard 255.

The exploration dashboard 255 enables defining queries that filter data. Query predicates go against the data warehouse, the inverted index search cluster, or the analytics database. Query outputs are refined manually. The final output is downloaded as a CSV, containing URNs to the selected assets.

As an example, consider learning a new concept, "left turns at intersections". The exploration dashboard is used to define and write a query joining and selecting videos within intersections that contain both detected traffic lights, and where the recording vehicle is turning left. The results are labeled samples, for the new concept. A CSV with URNs to the samples is saved onto a centralized storage file system folder. A new once job is submitted to job scheduler 225 that triggers model building. The result is a model that allows inference of left turns at intersections from vision data. Going forward, a job is submitted tor recurring streaming, to tag all incoming videos.

Below is provided the overall flow end-to-end for a new use case, e.g., data on demand to train a detector for left turns.

1. Go into the matched events web UI and define a sequence of kinematics sensor data readings that describe a left-turn.
2. Execute this query on the matched events web UI and fetch the underlying assets from the object store, corresponding to the matched events.
3. Insert the matched assets into a neural network training service and obtain as output a trained network.
4. Push the trained network to the clients.
5. Define in the query definitions web UI a query to match events when the confidence of detection in the above network is lower than 50%.
6. Push this query definition into the clients.
7. The client feeds the camera stream into the trained network.
8. The network generates detection events.
9. Detection events go through the query engine.
10. Events where probability <50% of being a left turn are matched.
11. Corresponding assets (frames in this case) are uploaded to object store.

-continued

12. Object store file insertion raises a message in the notification queue.
13. Triggered by the notification message, annotation service fetches matching asset from object store.
14. Annotation service runs neural network and generates detection events.
15. Detection events from annotation service run through DoD query engine.
16. Matched events go into database.

The V2V use case is analogous to the use case above, with two differences; namely, (i) client-side queries only match events from this client, and only require state from this client, and (ii) if network-wide state across multiple clients is required, these queries run on the V2V server.

Figure 15:
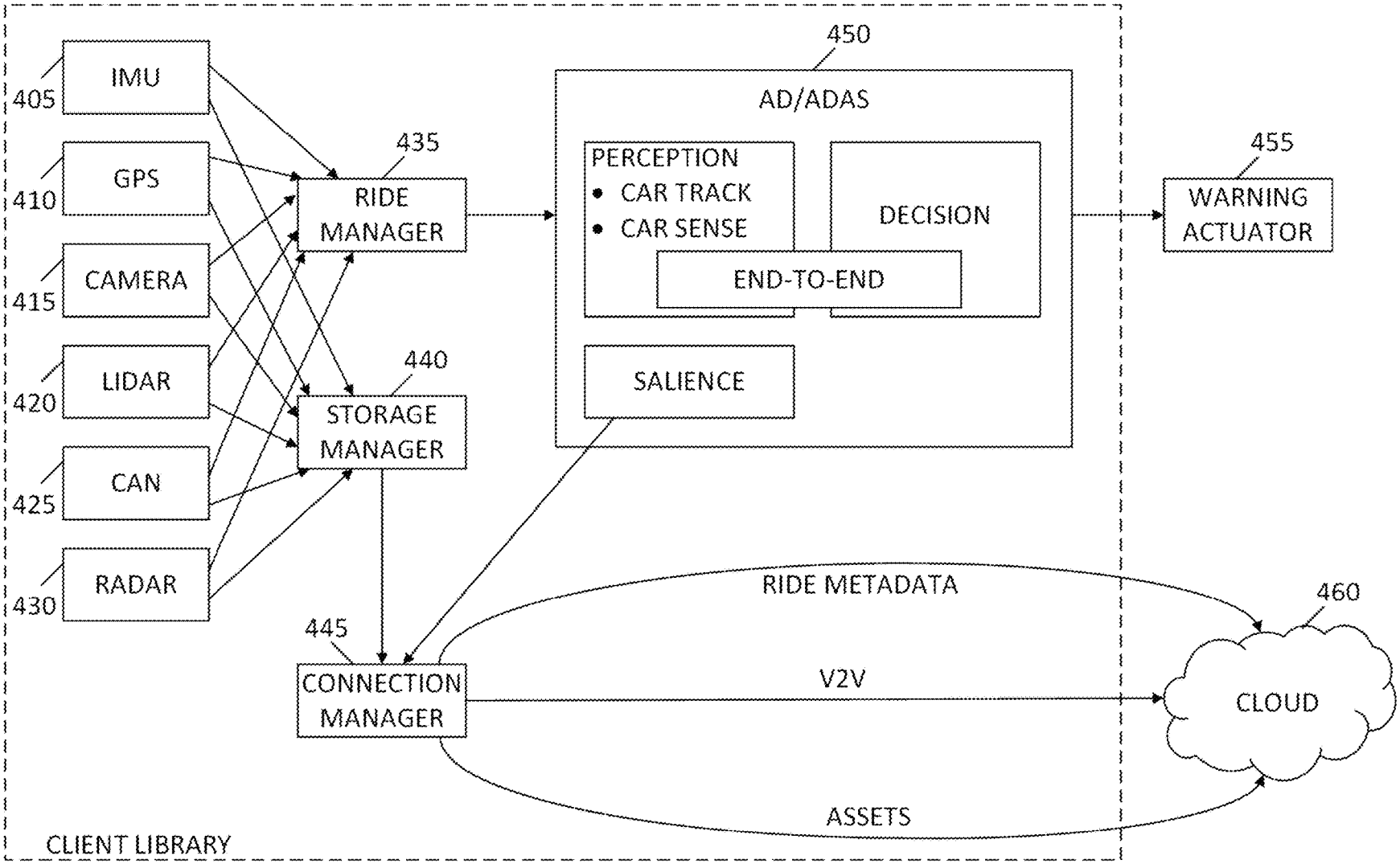
FIG. 15 is a high-level dataflow diagram for a client-side environment, in accordance with an embodiment of the present invention.

Reference is made to FIG. 15, which is a high-level dataflow diagram for a client-side environment, in accordance with an embodiment of the present invention. Shown in FIG. 15 are various sensors 405-430, including an inertial measurement unit (IMU) 405, a geographic positioning system (GPS) 410, a camera 415, a LiDAR 420, a CAN 425, and radar 430. Also shown in FIG. 8 are ride manager 435, storage manger 440, connection manager 445, and autonomous drive and advanced driver assistance system (AD/ADAS) 450. Elements 405-450 are components of a client library. In addition, FIG. 15 shows a warning actuator 455 and cloud 460. A key component shared between client and server is a "salience" algorithm, which selects interesting driving scenarios.

Figure 16:
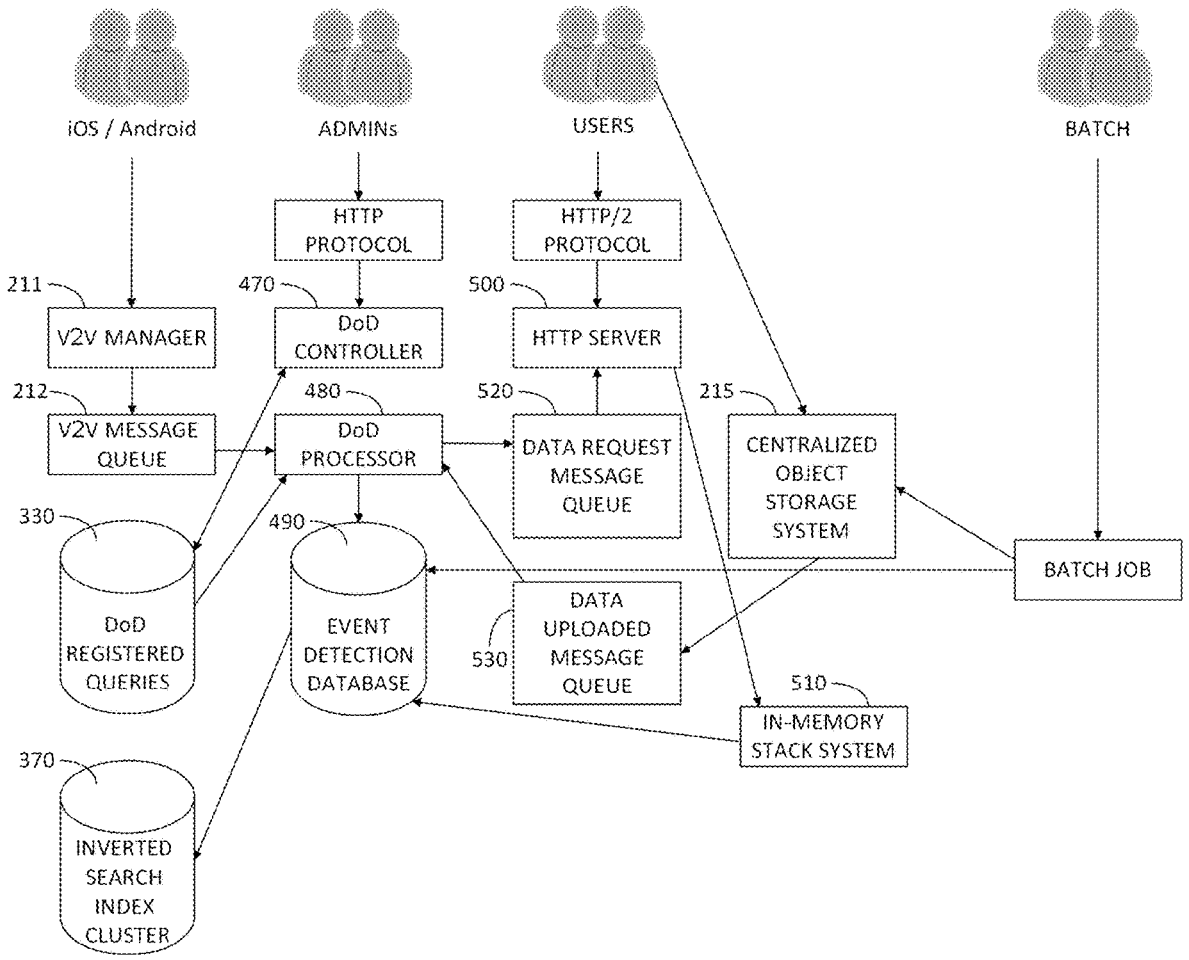
FIG. 16 is a high-level architectural view, in accordance with an embodiment of the present invention.

Reference is made to FIG. 16, which is a high-level architectural view, in accordance with an embodiment of the present invention. FIG. 16 shows that iOS and Android edge devices communicate with V2V manager 211, administrators access a DoD controller 470 via HTTP, and users communicate with an HTTP server 500 using the HTTP/2 protocol. Administrators create, read update and delete rules in the system that decide where, when and how data is to be retrieved from the clients to the cloud. DoD controller 470 exposes an API and UI to manage the registry of collection rules. Database 330 of DoD registered queries stores all the rules for collection data.

Figure 17:
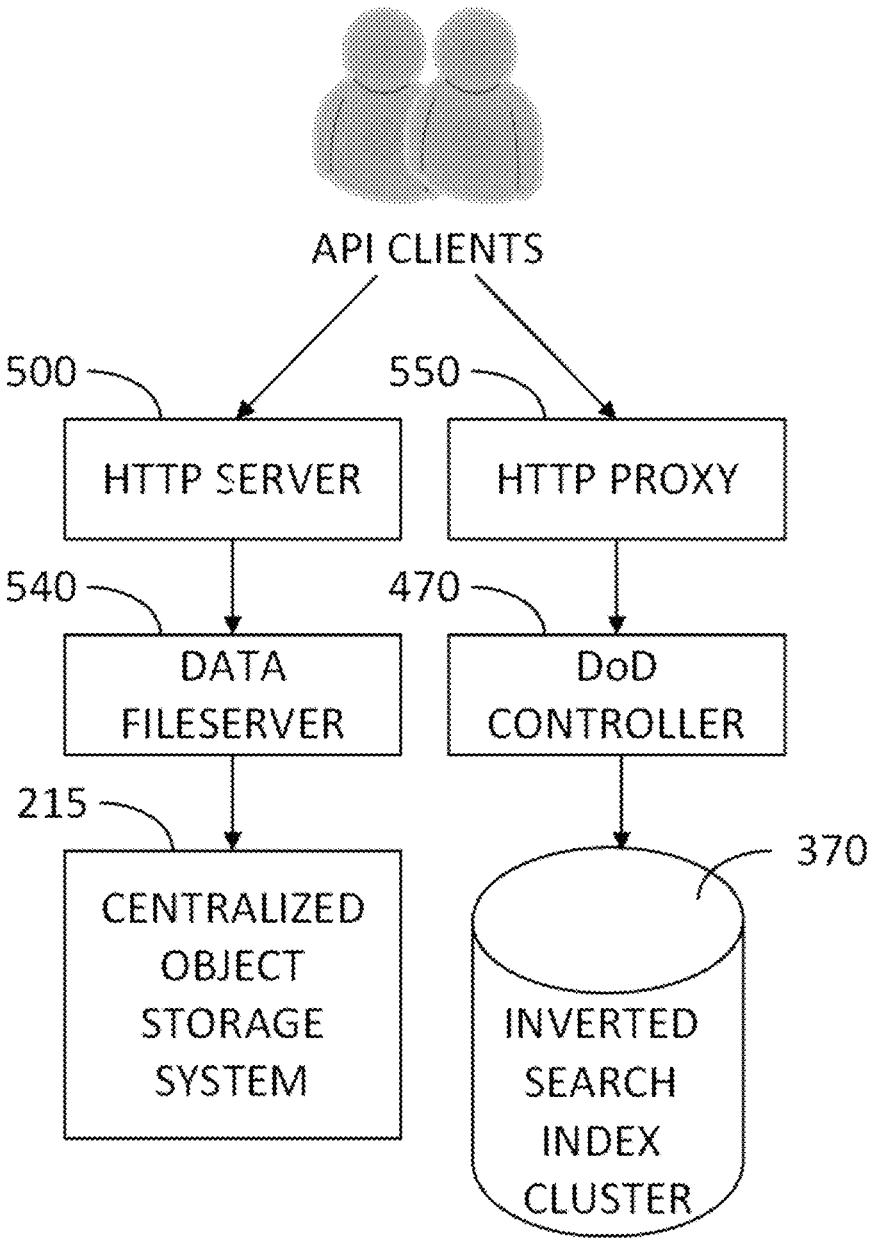
FIG. 17 is a simplified diagram of an HTTP proxy for searching and retrieving data, in accordance with an embodiment of the present invention.

Reference is made to FIG. 17, which is a simplified diagram of an HTTP proxy for searching and retrieving frames, in accordance with an embodiment of the present invention. An HTTP/1.1 GET method is used to search and retrieve frames from the inverted index search cluster 370. In order to avoid exposing the centralized object storage system 215 directly, a simple HTTP proxy 550 is put in front. The HTTP proxy is responsible for authentication using HTTP message headers.

It will be appreciated by those skilled in the art that the subject invention has widespread application to other fields of use in addition to public space management. In fact, the subject invention applied to any situation where there are edge devices with limited network connectivity and limited computing resourcing, which are thus unable to both transfer all data and analyze all data at the edge in depth. Hence, the need to a distributed and collaborative system like the present invention. As such, the subject invention is applicable to security cameras, to CCTV, to any IoT implementation, to fitness tracking devices, and to capturing edge cases; e.g., getting a knee injury while running on grass.

In the foregoing specification, the invention has been described with reference to specific exemplary embodiments thereof. It will, however, be evident that various modifications and changes may be made to the specific exemplary embodiments without departing from the broader spirit and scope of the invention. Accordingly, the specification and drawings are to be regarded in an illustrative rather than a restrictive sense.

What is claimed is:

1. A networked system for providing public space data on demand, comprising:

a plurality of vehicles riding on city and state roads, each vehicle comprising one or more edge devices with processing capability that capture frames of its vicinity;

a vehicle-to-vehicle network to which said plurality of vehicle are connected, receiving queries for specific types of frame data, propagating the queries to said plurality of vehicles, receiving replies to the queries from a portion of said plurality of vehicles, and delivering matched data by storing the matched data into a centralized storage server, wherein the queries relate to a member of the group consisting of traffic blockers, traffic analytics, infrastructure mapping, parking space detection, pedestrian counting and movement detection, and pattern detection across time and changes in the patterns; and a learner digitizing the public space in accordance with the received replies to the queries.

2. The networked system of claim 1, further comprising a cloud-based machine, connected to said learner, performing scene understanding.

3. The networked system of claim 1, further comprising a server managing queries, indexing and storing edge device output streams, and resolving geo-spatial queries, the server comprising an annotation service indexing incoming data.

4. The networked system of claim 1, wherein, for each vehicle ride, edge devices transfer data in response to queries (i) a priori, from data matched based on strategies cached on the client, before a ride begins, (ii) during the ride, by sending messages over a vehicle network, and (iii) post-ride, after the ride is finished.

5. The networked system of claim 1, wherein said one or more edge devices are smartphones.

6. A networked system for digitizing public space, comprising:

a plurality of mobile agents within vehicles, the mobile agents equipped with cameras and sensors and communicatively coupled via a vehicle network, the mobile agents continuously recording video, sensor data and metadata, and sending a portion of the recorded video, sensor data and metadata to a centralized cloud storage server, in response to receiving a query from a vehicle network server, wherein the query relates to a member of the group consisting of traffic blockers, traffic analytics, infrastructure mapping, parking space detection, pedestrian counting and movement detection, and pattern detection across time and changes in the patterns, the mobile agents comprising:

a learning machine (i) analyzing the video, sensor data and metadata to recognize objects in the video, sensor data and metadata, and (ii) determining which video, sensor data and metadata to send to the cloud, based on the received query, so as to maximize overall mutual information; and a centralized cloud storage server that receives the video, sensor data and metadata transmitted by the mobile agents, comprising:

an event classifier for analyzing event candidates and classifying events; and a query generator for directing said mobile agents to gather more information on a suspected event, via the vehicle network; and a map generator generating a dynamic city heatmap, and updating the heatmap based on subsequent videos, sensor data and metadata received by said mobile agents.

7. The networked system of claim 6 wherein said mobile agents comprise smartphones.

8. A computer-based method for providing public space data on demand, comprising:

propagating, by a vehicle network server, queries to a plurality of vehicles in communication with one another via a vehicle network, each vehicle including one or more edge devices that include cameras and other sensors, and that continuously generate videos, sensory data and metadata, wherein the queries relate to a member of the group consisting of traffic blockers, traffic analytics, infrastructure mapping, parking space detection, pedestrian counting and movement detection, and pattern detection across time and changes in the patterns;

transmitting a portion of the videos, sensory data and metadata to a centralized storage server, the portion being appropriate to one or more of the propagated queries;

indexing and annotating the received videos, sensory data and metadata, by the centralized storage server, sensory data and metadata; and digitizing and mapping the public space, based on the indexed and annotated videos, sensory data and metadata.

* * * * *